US010671011B2

(12) United States Patent
Saito et al.

(10) Patent No.: US 10,671,011 B2
(45) Date of Patent: Jun. 2, 2020

(54) IMAGE FORMING APPARATUS INCLUDING FIRST TO THIRD PIVOT MEMBERS PIVOTALLY MOVABLE IN INTERLOCKING RELATION TO EACH OTHER

(71) Applicant: Brother Kogyo Kabushiki Kaisha, Nagoya (JP)

(72) Inventors: Takashi Saito, Chiryu (JP); Yusuke Ikegami, Nagoya (JP)

(73) Assignee: Brother Kogyo Kabushiki Kaisha, Nagoya-Shi (JP)

( * ) Notice: Subject to any disclaimer, the term of this patent is extended or adjusted under 35 U.S.C. 154(b) by 0 days.

(21) Appl. No.: 16/051,579

(22) Filed: Aug. 1, 2018

(65) Prior Publication Data

US 2019/0049893 A1 Feb. 14, 2019

(30) Foreign Application Priority Data

Aug. 10, 2017 (JP) ..... 2017-154863

(51) Int. Cl.
*G03G 21/16* (2006.01)

(52) U.S. Cl.
CPC ..... *G03G 21/1638* (2013.01); *G03G 21/1633* (2013.01); *G03G 21/1647* (2013.01)

(58) Field of Classification Search
CPC ..... G03G 21/1623; G03G 21/1638
See application file for complete search history.

(56) References Cited

U.S. PATENT DOCUMENTS

2010/0158560 A1* 6/2010 Watanabe ..... G03G 21/1633 399/110
2017/0255159 A1* 9/2017 Inada ..... G03G 21/1633

FOREIGN PATENT DOCUMENTS

JP 2007-168405 A 7/2007
JP 2007-328302 A 12/2007

* cited by examiner

*Primary Examiner* — Victor Verbitsky
(74) *Attorney, Agent, or Firm* — Burr & Brown, PLLC

(57) ABSTRACT

An image forming apparatus includes: a casing; a cover; a locked portion provided at one of the casing and the cover; and a locking portion provided at remaining one of the casing and the cover. The locking portion includes: a first pivot member; a second pivot member spaced apart from the first pivot member; and a third pivot member. Each of the first pivot member and the second pivot member is pivotally movable between an engaging position and a release position about a first axis. The third pivot member is pivotally movable between a first position and a second position about a second axis. Pivotal movement of at least one of the first pivot member, the second pivot member, and the third pivot member causes pivotal movement of the remaining of the first pivot member, the second pivot member, and the third pivot member.

2 Claims, 11 Drawing Sheets

LEFT
RIGHT
REAR
FRONT
UP
DOWN
41
41B
61B
63A
43A
40
431
43
63B
43B
62A
42A
42
42B
62B
46
41D
432
47
42D
33

R1
R2
41C
41A
41
41D
46
41B
71
72
43A
431
43
432
40
43B
42A
73
74
42
42D
42B
42C
47

IMAGE FORMING APPARATUS INCLUDING FIRST TO THIRD PIVOT MEMBERS PIVOTALLY MOVABLE IN INTERLOCKING RELATION TO EACH OTHER

CROSS REFERENCE TO RELATED APPLICATION

This application claims priority from Japanese Patent Application No. 2017-154863 filed Aug. 10, 2017. The entire content of the priority application is incorporated herein by reference.

TECHNICAL FIELD

The present disclosure relates to an image forming apparatus.

BACKGROUND

Japanese Patent Application Publication No. 2007-168405 discloses an image forming apparatus including: a casing whose front side is formed with an opening; and a cover unit for opening and closing the opening. With such an image forming apparatus, a user can perform maintenance such as replacement of parts and components, replenishment of expendable supplies, or processing for sheet jamming by opening the cover unit.

Further, the image forming apparatus disclosed in Japanese Patent Application Publication No. 2007-168405 includes a locking portion for locking the cover relative to the casing. The locking portion is provided at an upper portion of the casing. The locking portion includes a single shaft extending in a left-right direction at an upper portion of the front surface of the casing, and an engagement arm provided at each end portion of the shaft.

SUMMARY

However, when such the locking portion is provided at the upper portion of the casing, the locking portion may be impeditive against other parts or components to be provided at the upper portion of the casing. For example, in case a discharge tray is provided at an upper surface of the casing, a paper stopper may be desired at a front portion of the upper surface of the casing. The paper stopper may be pivotally movable between a position in which the paper stopper is accommodated in a recessed portion formed in the upper surface of the casing, and a position in which the paper stopper upstands from the discharge tray.

In a case where the above-described paper stopper is provided at the upper surface of the casing, the recessed portion must be positioned above the shaft so as to avoid mechanical interference therebetween. That is, a space for providing the paper stopper and a space for providing the locking portion are individually required in an up-down direction. This may cause increase in size of the image forming apparatus in the up-down direction.

This problem is not only caused by providing of the paper stopper. For example, similar problem may occur in a case where an operation panel or an NFC (near field ratio communication) device is desired to be provided at the front portion of the upper surface of the casing.

In view of the foregoing, it is an object of the disclosure to provide an image forming apparatus capable of restraining an increase in dimension in a height direction of a casing even if a locking portion and other parts or components are provided on an upper front portion of the casing.

In order to attain the above and other objects, according to one aspect, the disclosure provides an image forming apparatus including: a casing; a cover; a locked portion; and a locking portion. The casing is formed with an opening. The cover is movable between a closed position and an open position. The cover in the closed position closes the opening. The cover in the open position opens the opening. The locked portion is provided at one of the casing and the cover. The locked portion includes: a first engaged portion; and a second engaged portion. The locking portion is provided at remaining one of the casing and the cover. The locking portion includes: a first pivot member; a second pivot member; a third pivot member; and an urging member. The first pivot member is pivotally movable between an engaging position and a release position about a first axis extending in an axial direction. The first pivot member includes a first engaging portion configured to be engaged with the first engaged portion. The first engaging portion is engaged with the first engaged portion in the engaging position of the first pivot member. The first engaging portion is disengaged from the first engaged portion in the release position of the first pivot member. The second pivot member is spaced apart from the first pivot member in the axial direction and is pivotally movable between an engaging position and a release position about the first axis. The second pivot member includes a second engaging portion configured to be engaged with the second engaged portion. The second engaging portion is engaged with the second engaged portion in the engaging position of the second pivot member. The second engaging portion is disengaged from the second engaged portion in the release position of the second pivot member. The third pivot member is pivotally movable between a first position and a second position about a second axis extending in the axial direction. The third pivot member is in the first position in a state where the first pivot member and the second pivot member are in the engaging position. The third pivot member is in the second position in a state where the first pivot member and the second pivot member are in the release position. Pivotal movement of at least one of the first pivot member, the second pivot member, and the third pivot member causes pivotal movement of remaining of the first pivot member, the second pivot member, and the third pivot member. The urging member is configured to urge the first pivot member to be pivotally moved to the engaging position and to urge the second pivot member to be pivotally moved to the engaging position.

BRIEF DESCRIPTION OF THE DRAWINGS

The particular features and advantages of the embodiment(s) as well as other objects will become apparent from the following description taken in connection with the accompanying drawings, in which.

DETAILED DESCRIPTION

Figure 1:
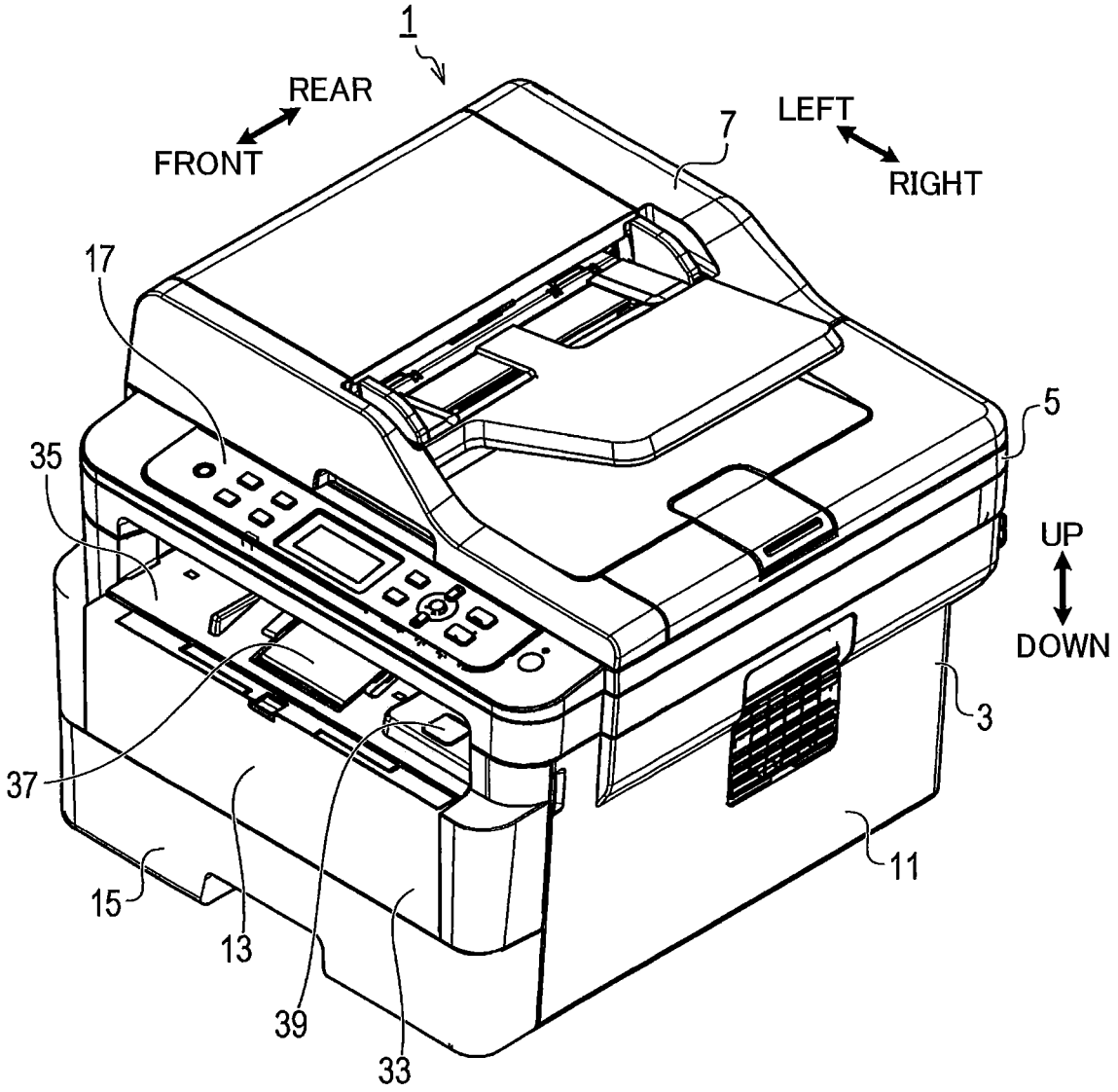
FIG. 1 is a perspective view of a multifunction peripheral according to a first embodiment of the present disclosure.
Figure 2:
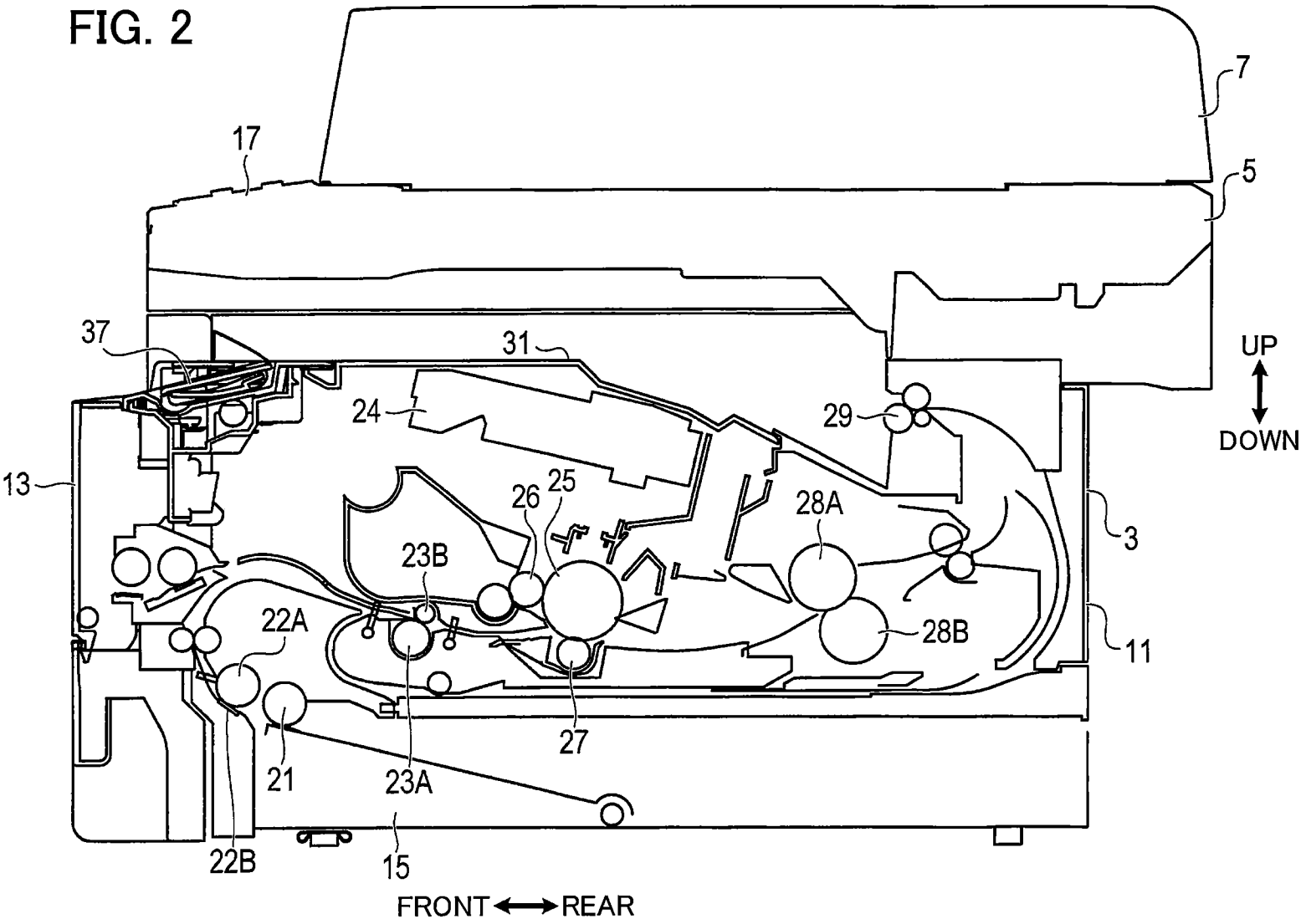
FIG. 2 is a vertical cross-sectional view of the multifunction peripheral according to the first embodiment, and illustrating a closed position of a cover unit of the multifunction peripheral.
Figure 3:
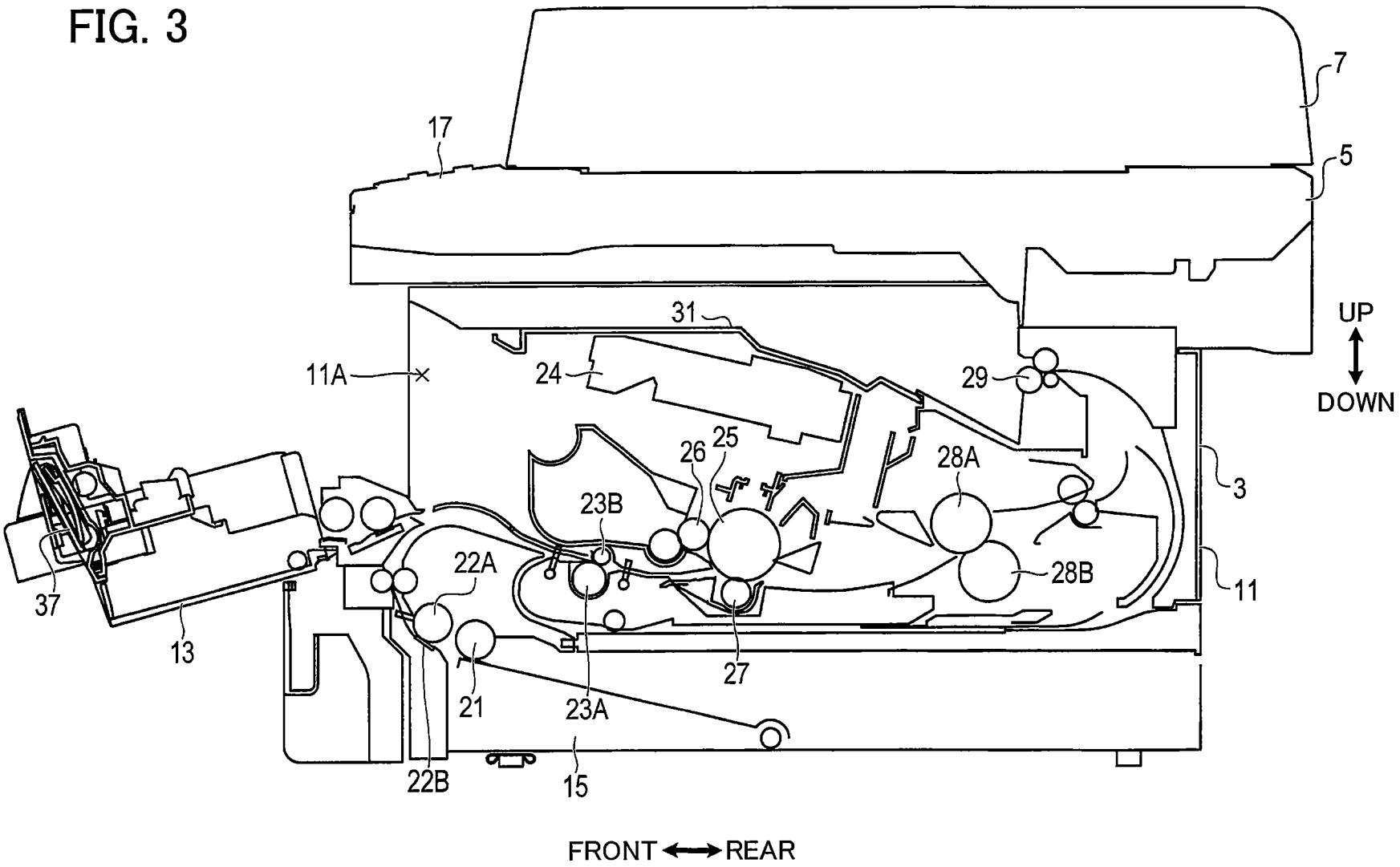
FIG. 3 is a vertical cross-sectional view of the multifunction peripheral according to the first embodiment, and illustrating an open position of the cover unit.

Hereinafter, a multifunction peripheral 1 as an example of an image forming apparatus according to a first embodiment of the present disclosure will be described with reference to FIGS. 1 through 10. The multifunction peripheral 1 has an image forming function such as printing, and other functions such as image-scanning function, a copying function, and a facsimile function.

In the following description, up, down, left, right, left, front, and rear those are illustrated in the drawings will be used to simply describe relative positions of parts and components of the multifunction peripheral 1.

<Configuration of Multifunction Peripheral>

As illustrated in FIG. 1, the multifunction peripheral 1 includes a main body portion 3, an FB (flat-bed) portion 5, and an ADF (automatic document feeder) portion 7. The main body portion 3 includes a casing 11, a cover unit 13, and a sheet tray 15. An operation panel 17 is provided at a front portion of the FB portion 5. The cover unit 13 is pivotally movable between a closed position (a position illustrated in FIG. 2) and an open position (a position illustrated in FIG. 3). The casing 11 has a front wall formed with an opening 11A (see FIG. 3). The opening 11A is closed with the cover unit 13 in a state where the cover unit 13 is positioned at the closed position, and the opening 11A is open to the outside in a state where the cover unit 13 is positioned at the open position. The cover unit 13 is an example of a cover.

A suction roller 21, a separation roller 22A, a separation pad 22B, a pair of registration rollers 23A and 23B, an exposure unit 24, a photosensitive member 25, a developing roller 26, a transfer roller 27, a heat roller 28A, a pressure roller 28B, and a discharge roller 29 are provided in the casing 11. A sheet accommodated in the sheet tray 15 is sucked by the suction roller 21, and is separated from a sheet stack remaining on the sheet tray 15 by the separation roller 22A and the separation pad 22B, and is conveyed downstream in a sheet conveying direction. Upon abutment of a leading edge of the sheet on the pair of registration rollers 23A and 23B, the leading edge of the sheet is subjected to positioning and inclination of the sheet relative to the sheet conveying direction is corrected.

The exposure unit 24 is configured to emit laser beam to scan the photosensitive member 25, thereby forming an electrostatic latent image on a surface of the photosensitive member 25. The developing roller 26 has a surface in contact with the surface of the photosensitive member 25 and carrying developing agent. Therefore, the electrostatic latent image formed on the surface of the photosensitive member 25 becomes a visible image. The transfer roller 27 and the photosensitive member 25 nip the sheet therebetween so as to transfer the visible image on the surface of the photosensitive member 25 to the sheet. The heat roller 28A and the pressure roller 28B nip the sheet on which the visible image is transferred therebetween to apply heat and pressure to the sheet. Accordingly, the visible image transferred onto the sheet is fixed to the sheet.

Figure 4A:
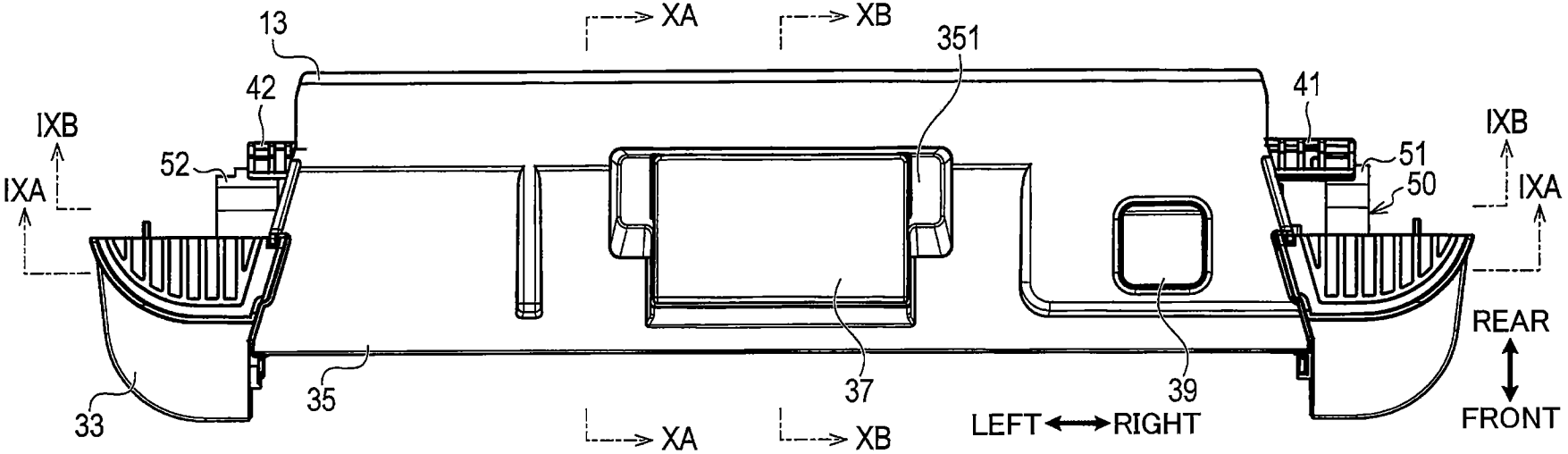
FIG. 4A is a plan view of the cover unit and a locked portion of the multifunction peripheral according to the first embodiment.

The sheet on which an image is formed is discharged onto an upper surface of the main body portion 3 by the discharge roller 29. A space is provided between the main body portion 3 and the FB portion 5. A discharge tray 31 is constituted by an upper surface of the casing 11 and an upper surface of the cover unit 13. As illustrated in FIG. 4A, the cover unit 13 includes a cover body 33, a cover top 35, a sheet stopper 37, and an unlock button 39. The cover top 35 constitutes a portion of the discharge tray 31 in a state where the cover unit 13 is at the closed position.

The sheet stopper 37 is assembled to the cover top 35, and is movable between a used position at which the sheet stopper 37 is used and a non-used position at which the sheet stopper 37 is not used. In the used position, the sheet stopper 37 is configured to prevent a sheet discharged onto the discharge tray 31 from dropping out of the discharge tray 31. The cover top 35 has an accommodating portion 351 capable of accommodating the sheet stopper 37 at its non-used position. The accommodating portion 351 is recessed downward from an upper surface of the cover top 35.

Figure 10B:
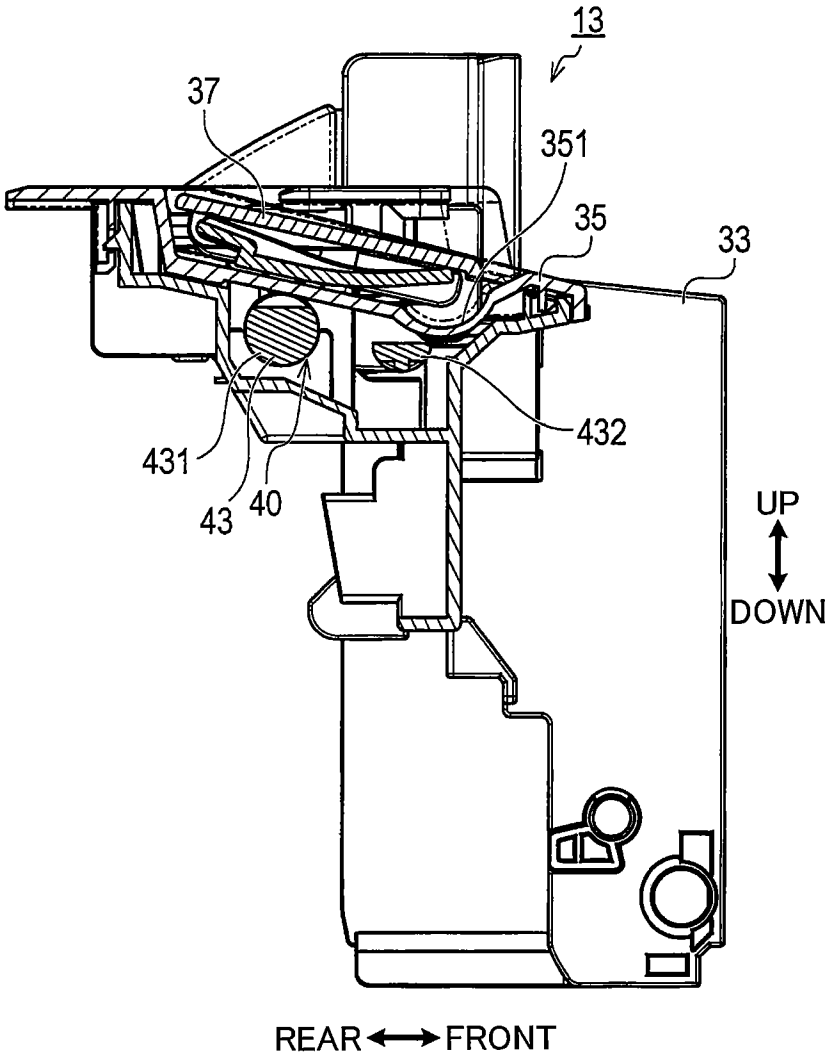
FIG. 10B is a cross-sectional view taken along a line XB-XB in FIG. 4A.
Figure 10A:
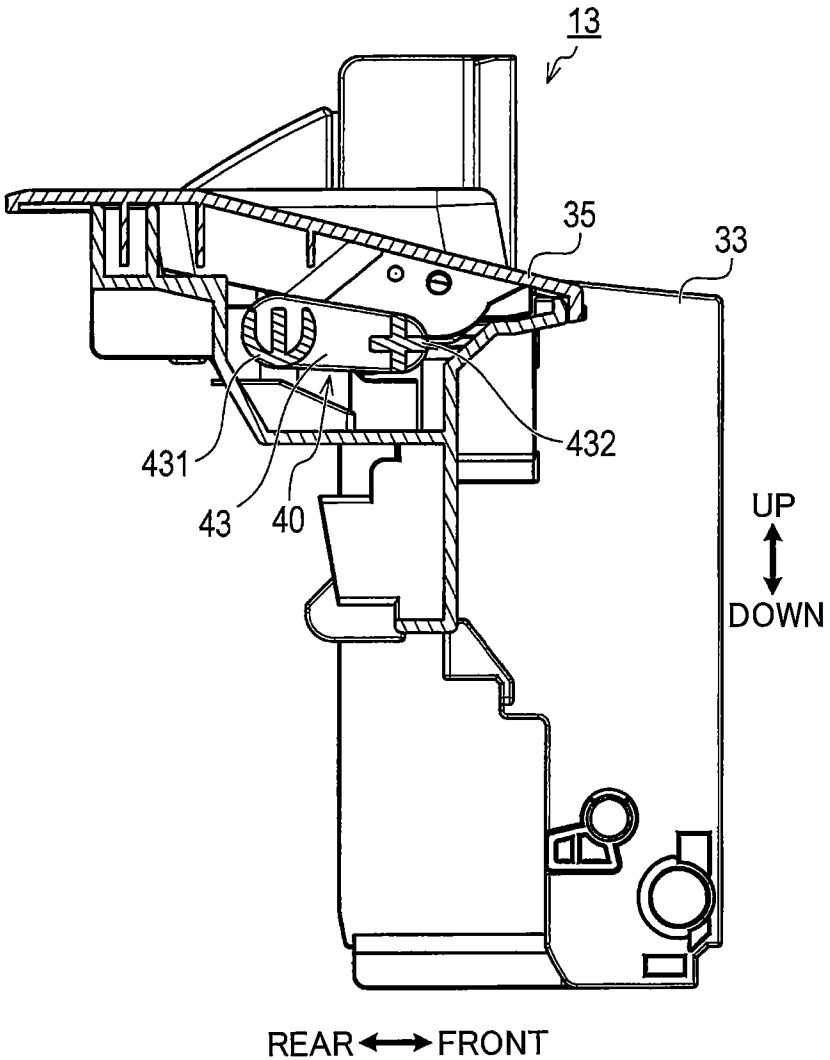
FIG. 10A is a cross-sectional view taken along a line XA-XA in FIG. 4A.

The upper surface of the cover top 35 is sloped downward as extending frontward, as illustrated in FIG. 10A. Hence, a dimension in the up-down direction of the space between the main body portion 3 and the FB portion 5 is gradually enlarged toward the front side, and therefore the user can easily take out the sheet discharged onto the discharge tray 31. In the non-used position, the sheet stopper 37 is accommodated in the accommodating portion 351 such that the upper surface of the sheet stopper 37 is flush with the upper surface of the cover top 35. In the used position, the sheet stopper 37 upstands from the cover top 35.

Figure 4B:
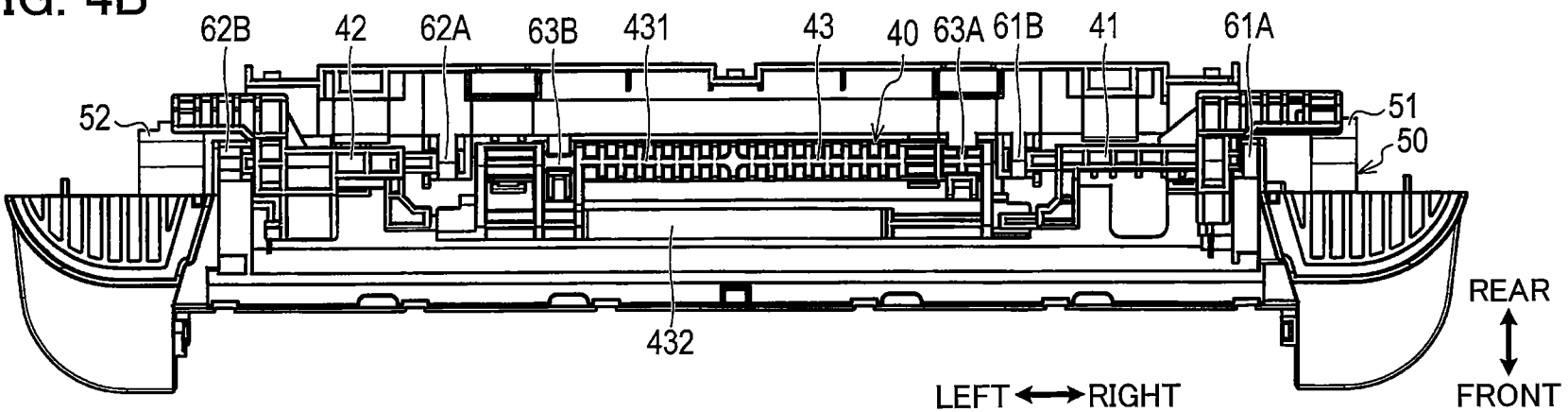
FIG. 4B is a plan view of a cover body, a locking portion, and the locked portion of the multifunction peripheral according to the first embodiment.
Figures 5A, 5B:
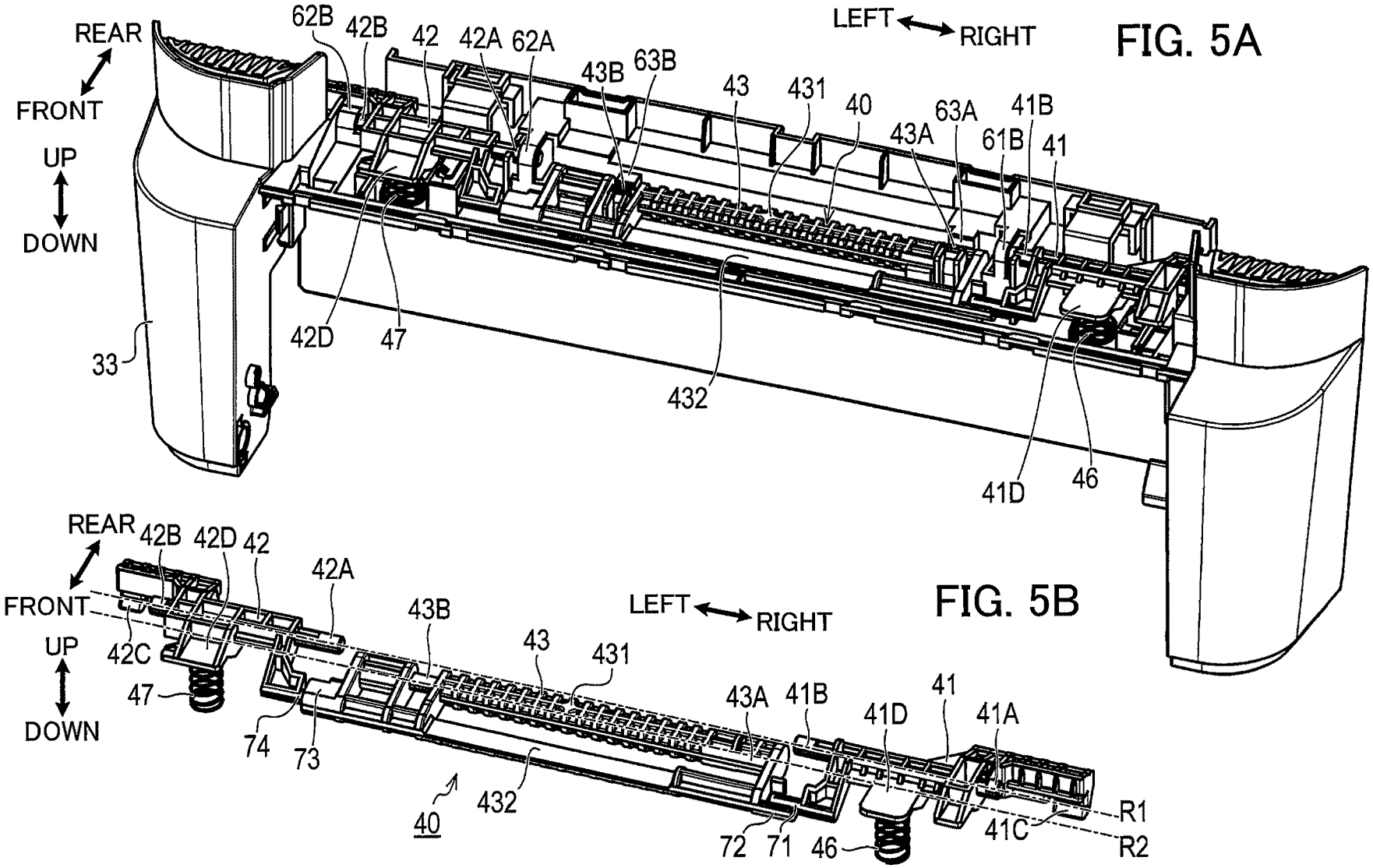
FIG. 5A is a perspective view of the cover body and the locking portion.
FIG. 5B is a perspective view of the locking portion.

As illustrated in FIGS. 4B, 5A and 5B, a locking portion 40 is provided in the cover unit 13 at a position below the cover top 35. The locking portion 40 includes a first pivot member 41, a second pivot member 42, a third pivot member 43, a first urging member 46, and a second urging member 47.

Figure 6B:
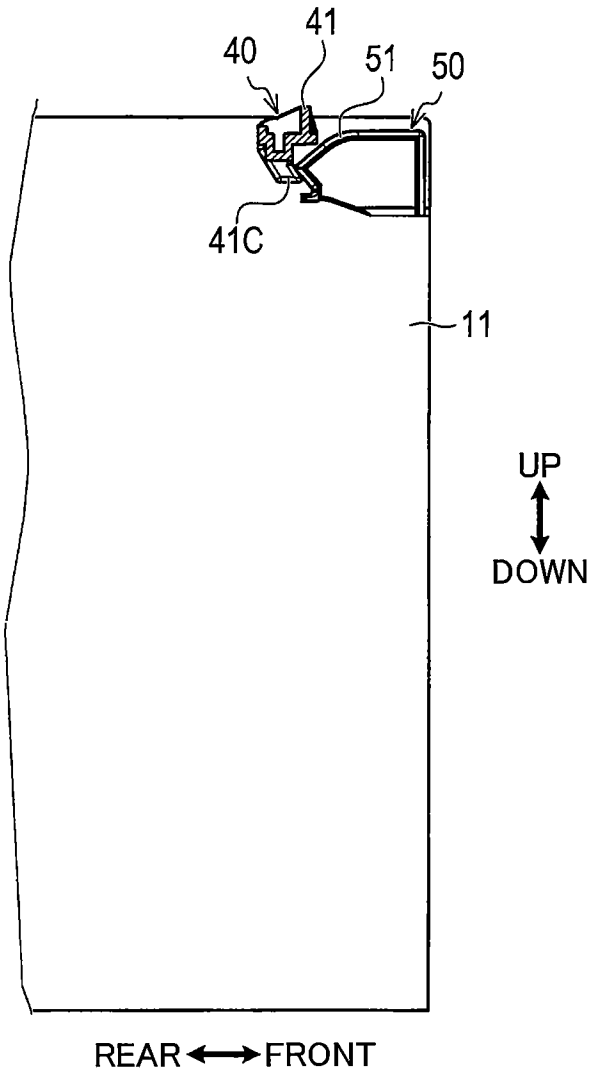
FIG. 6B is a vertical cross-sectional view of the first engaged portion and components adjacent thereto in the multifunction peripheral according to the first embodiment.
Figure 6A:
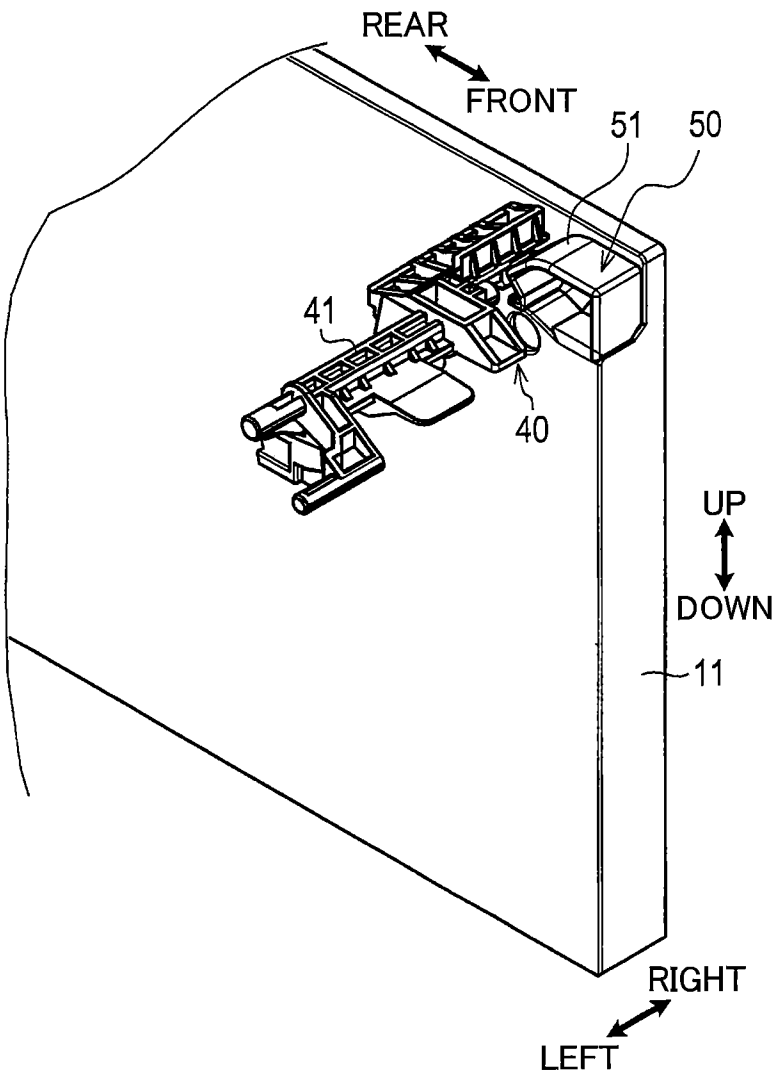
FIG. 6A is a perspective view of a first engaged portion and components adjacent thereto in the multifunction peripheral according to the first embodiment.

As illustrated in FIGS. 4A and 4B, a locked portion 50 is provided in the casing 11. The locked portion 50 includes a first engaged portion 51 and a second engaged portion 52. As illustrated in FIGS. 6A and 6B, the first engaged portion 51 is positioned at an upper front portion of the casing 11. The second engaged portion 52 illustrated in FIG. 4B is positioned generally symmetrically with the first engaged portion 51 in the left-right direction.

The first pivot member 41 is positioned at a right portion of the cover unit 13, and includes shafts 41A, 41B (see FIG. 5B). Bearings 61A, 61B (see FIG. 4B) provided at the cover body 33 rotatably support the shafts 41A, 41B, respectively, so that the shafts 41A, 41B are rotatable about a first axis R1 (see FIG. 9B). The first pivot member 41A includes a first engaging portion 41C and a first protruding portion 41D. The first pivot member 41 is pivotally movable between an engaging position (see FIG. 7A) where the first engaging portion 41C is engaged with the first engaged portion 51, and a release position (see FIG. 7B) where the first engaging portion 41C is disengaged from the first engaged portion 51.

The shaft 41A of the first pivot member 41 extends rightward, and the shaft 41B extends leftward such that the shafts 41A and 41B extend along the first axis R1. The first engaging portion 41C is positioned rightward and rearward of the shaft 41A. The shafts 41A and 41B are an example of a first shaft.

The second pivot member 42 is positioned at a left portion of the cover unit 13, and includes shafts 42A, 42B (see FIG. 5B). Bearings 62A, 62B (see FIG. 5A) provided at the cover body 33 rotatably support the shafts 42A, 42B, respectively, so that the shafts 42A, 42B are rotatable about the first axis R1. The second pivot member 42A includes a second engaging portion 42C and a second protruding portion 42D. The second pivot member 42 is pivotally movable between an engaging position where the second engaging portion 42C is engaged with the second engaged portion 52, and a release position where the engagement between the second engaging portion 42C and the second engaged portion 52 is released. The first pivot member 41 and the second pivot member 42 are arranged in an extending direction (i.e., the left-right direction) of the first axis R1 with a gap between the first pivot member 41 and the second pivot member 42. The left-right direction is an example of an axial direction.

The shaft 42A of the second pivot member 42 extends rightward, and the shaft 42B extends leftward such that the shafts 42A, 42B extend along the first axis R1. The second engaging portion 42C is positioned leftward of and rearward of the shaft 42B. The shafts 42A and 42B are an example of a second shaft.

The third pivot member 43 includes a center shaft 431 coaxial with a second axis R2 (see FIG. 9B) extending in parallel with the first axis R1, and a parallel shaft 432 extending in parallel with the center shaft 431. The center shaft 431 includes shafts 43A, 43B (see FIG. 5B) rotatably supported by bearings 63A, 63B (FIG. 5A) provided at the cover body 33, respectively. With this configuration, the shafts 43A, 43B are rotatable about the second axis R2. Further, the parallel shaft 432 is movable about the center shaft 431 (i.e., the second axis R2) in accordance with rotation of the center shaft 431.

The shaft 43A of the third pivot member 43 and the bearing 63A provided at the cover body 33 are positioned leftward and downward of the shaft 41B of the first pivot member 41 and the bearing 61B provided at the cover body 33.

The shaft 43B of the third pivot member 43 and the bearing 63B provided at the cover body 33 are positioned rightward and downward of the shaft 42A of the second pivot member 42 and the bearing 62A provided at the cover body 33. The shafts 43A and 43B are an example of a third shaft.

The parallel shaft 432 of the third pivot member 43 is positioned downward and frontward of the center shaft 431.

The first urging member 46 is a compression spring interposed between the cover body 33 and the first protruding portion 41D, and is configured to urge the first protruding portion 41D upward. With this configuration, the first pivot member 41 is urged so as to be pivotally moved from the release position toward the engaging position.

The second urging member 47 is a compression spring interposed between the cover body 33 and the second protruding portion 42D, and is configured to urge the second protruding portion 42D upward. Thus, the second pivot member 42 is urged so as to be pivotally moved from the release position to the engaging position.

The first protruding portion 41D is positioned immediately below the unlock button 39. The unlock button 39 has a protruding portion 39A protruding downward (see FIG. 9A). The protruding portion 39A has a lower end in contact with an upper surface of the first protruding portion 41D. Urging members 39B (compression springs) are interposed between the unlock button 39 and the cover top 35, thereby urging the unlock button 39 upward.

Figure 8A:
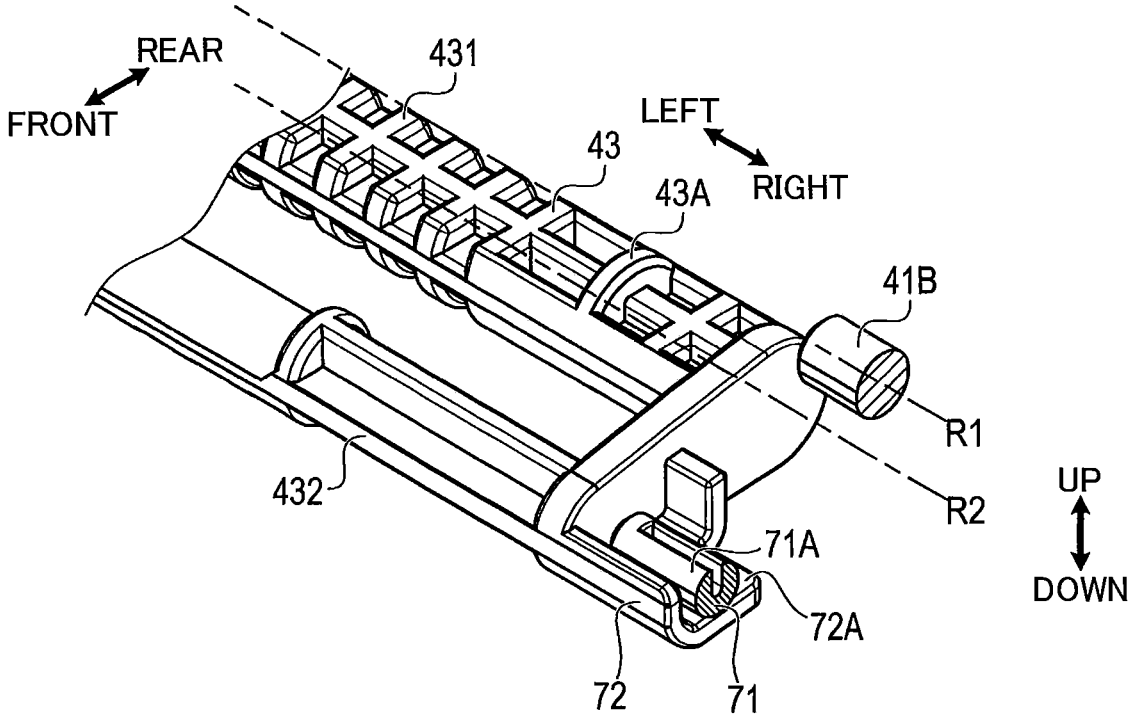
FIG. 8A is a perspective view of a first transmitting portion and a first transmission-receiving portion of the multifunction peripheral according to the first embodiment.

A first transmission portion 71 is provided at the first pivot member 41. As illustrated in FIG. 8A, the first transmission portion 71 includes a first contact portion 71A having a shaft shape. The first transmission portion 71 is pivotally movable together with the first pivot member 41. A first transmission-receiving portion 72 is provided at a right end of the third pivot member 43. The first transmission-receiving portion 72 has a concave surface serving as a first guide surface 72A. The first guide surface 72A faces upward. That is, the first guide surface 72A is recessed downward.

The parallel shaft 432 has a right end connected to the first transmission-receiving portion 72. Therefore, the first transmission-receiving portion 72 is pivotally movable along with the third pivot member 43. The first transmission portion 71 and the first transmission-receiving portion 72 are in contact with each other at a position away from both the first axis R1 and the second axis R2.

The first contact portion 71A of the first transmission portion 71 provided at the first pivot member 41 is positioned downward and frontward of the shaft 41B, and extends leftward. The first guide surface 72A of the first transmission-receiving portion 72 provided at the third pivot member 43 is positioned downward and frontward of the shaft 43A, and extends rightward.

Pivotal movement of the first pivot member 41 causes the pivotal movement of the first transmission portion 71 so as to press the first transmission-receiving portion 72 downward. The first transmission-receiving portion 72 is pivotally moved along with the third pivot member 43 upon power transmission from the first transmission portion 71. At this time, the first contact portion 71A is moved along the first guide surface 72A while maintaining contact with the first guide surface 72A. In this way, the first transmission portion 71 is movable in sliding contact with the first transmission-receiving portion 72 to pivotally move the first transmission-receiving portion 72, despite the fact that a pivot center (i.e., the first axis R1) of the first transmission portion 71 is different from a pivot center (i.e., the second axis R2) of the first transmission-receiving portion 72.

Figure 8B:
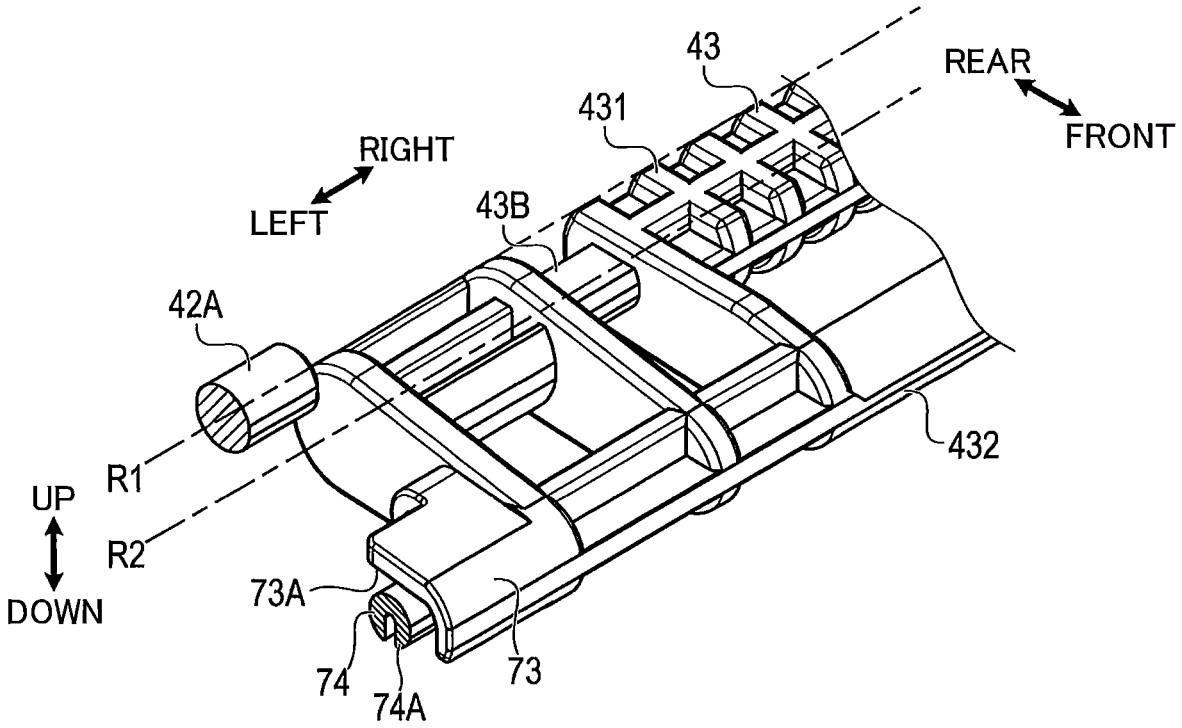
FIG. 8B is a perspective view of a second transmitting portion and a second transmission-receiving portion of the multifunction peripheral according to the first embodiment.

A second transmission portion 73 is provided at a left end of the third pivot member 43. As illustrated in FIG. 8B, the second transmission portion 73 has a concave surface serving as a second guide surface 73A. The second guide surface 73A faced downward. In other words, the second guide surface 73A is recessed upward. The parallel shaft 432 has a left end connected to the second transmission portion 73. The second transmission portion 73 is pivotally movable along with the third pivot member 43.

A second transmission-receiving portion 74 is provided the second pivot member 42. The second transmission-receiving portion 74 includes a second contact portion 74A having a shaft shape, and is pivotally movable together with the second pivot member 42. The second transmission portion 73 and the second transmission-receiving portion 74 are in contact with each other at a position away from both the first axis R1 and the second axis R2.

The second guide surface 73A of the second transmission portion 73 provided at the third pivot member 43 is positioned downward and frontward of the shaft 43B, and extends leftward. The second contact surface 74A of the second transmission-receiving portion 74 provided at the second pivot member 42 is positioned downward and frontward of the shaft 42A, and extends rightward.

As the third pivot member 43 is pivotally moved, the second transmission portion 73 is also pivotally moved, thereby pressing the second transmission-receiving portion 74 downward. The second transmission-receiving portion 74 is pivotally moved along with the second pivot member 42 upon power transmission from the second transmission portion 73. In this case, the second contact surface 74A is moved along the second guide surface 73A while maintaining contact with the second guide surface 73A. Accordingly, the second transmission portion 73 is movable in sliding contact with the second transmission-receiving portion 74 to pivotally move the second transmission-receiving portion 74, irrespective of the fact that a pivot center (i.e., the second axis R2) of the second transmission portion 73 is different from a pivot center (i.e., the first axis R1) of the second transmission-receiving portion 74.

Figure 7A:
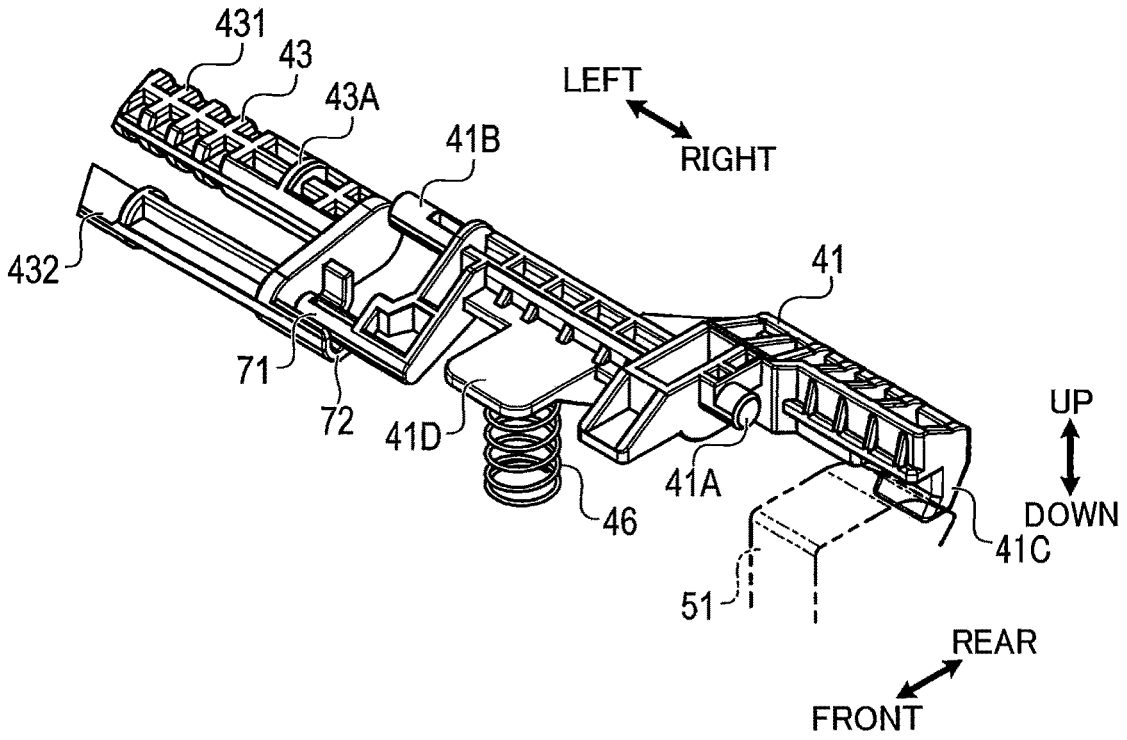
FIG. 7A is a perspective view of a first engaging portion in the multifunction peripheral according to the first embodiment, and illustrating an engaging position of the first engaging portion.
Figure 7B:
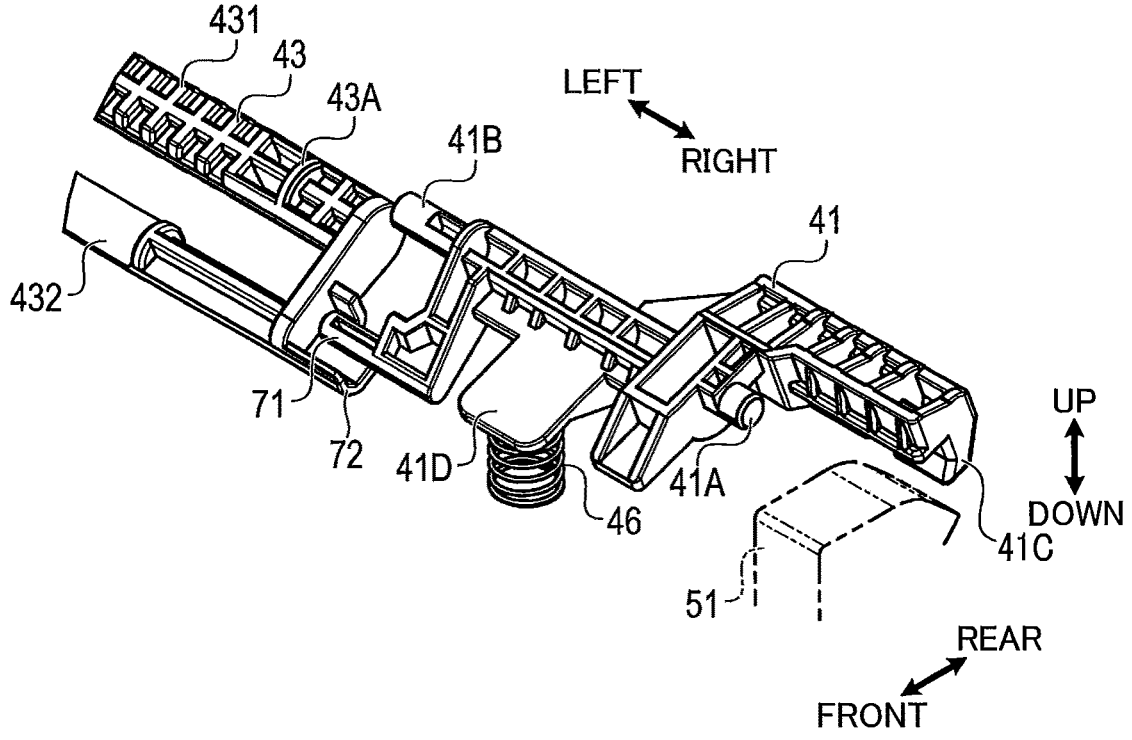
FIG. 7B is a perspective view of the first engaging portion in a release position.

As illustrated in FIG. 7A, the third pivot member 43 is positioned at a first position in a state where the first pivot member 41 is at its engaging position in which the first engaging portion 41C is engaged with the first engaged portion 51. At this time, the second pivot member 42 is also at the engaging position where the second engaging portion 42C is engaged with the second engaged portion 52. Further, as illustrated in FIG. 7B, the third pivot member 43 is positioned at a second position when the first pivot member 41 is at its release position in which the first engaging portion 41C is disengaged from the first engaged portion 51. At this time, the second pivot member 42 is also at the release position where the engagement between the second engaging portion 42C and the second engaged portion 52 is released.

More specifically, an upper surface of the center shaft 431 of the third pivot member 43 faces upward in the first position of the third pivot member 43, while the upper surface of the center shaft 431 faces diagonally frontward and upward as a result of slight pivotal movement of the center shaft 431 in the second position of the third pivot member 43. Further, a position of the parallel shaft 432 in the second position of the third pivot member 43 is lower than the position of the parallel shaft 432 in the first position of the third pivot member 43.

With the above configuration, when the user presses the unlock button 39 downward, the first pivot member 41 is pivotally moved, so that the third pivot member 43 is pivotally moved in interlocking relation to the first pivot member 41, and the second pivot member 42 is pivotally moved in interlocking relation to the third pivot member 43. Thus, both the first pivot member 41 and the second pivot member 42 are moved from the engaging position to the release position to release engagement of the first engaging portion 41C and the second engaging portion 42C with the first engaged portion 51 and the second engaged portion 52, respectively, thereby releasing locking of the cover unit 13 relative to the casing 11. As a result, the cover unit 13 is movable to the open position.

Further, when the cover unit 13 is moved from the open position to the closed position, the first pivot member 41, the second pivot member 42, and the second pivot member 43 are pivotally moved in interlocking relation to each other by the urging forces of the first urging member 46 and the second urging member 47. In this way, the first pivot member 41 and the second pivot member 42 are moved back to the engaging position, so that the first engaging portion 41C and the second engaging portion 42C are brought into engagement with the first engaged portion 51 and the second engaged portion 52, respectively. These engagements cause the cover unit 13 to be immovable from the closed position.

Figure 9A:
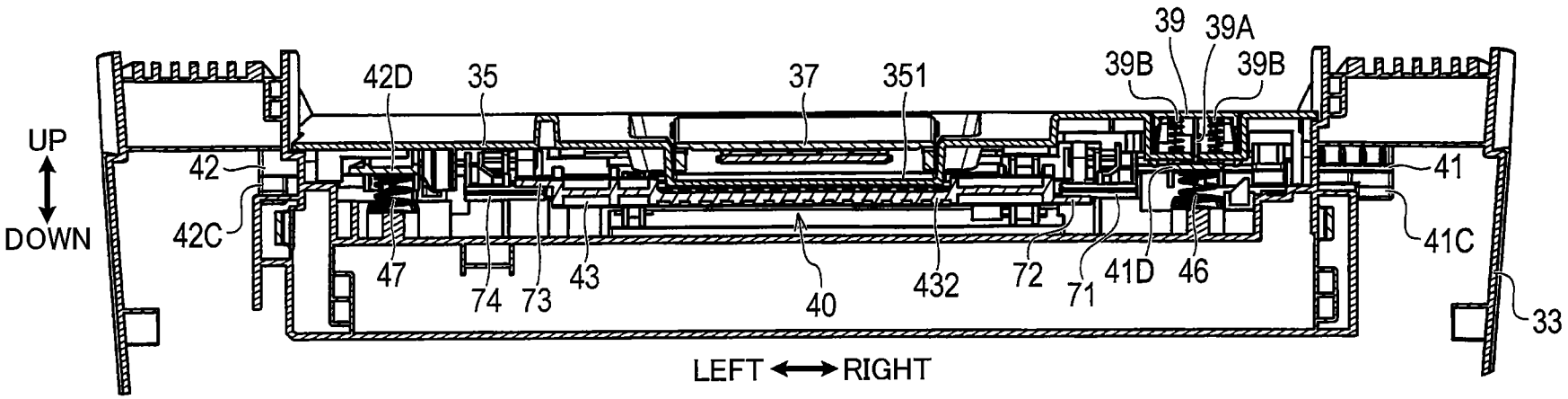
FIG. 9A is a cross-sectional view taken along a line IXA-IXA in FIG. 4A.
Figure 9B:
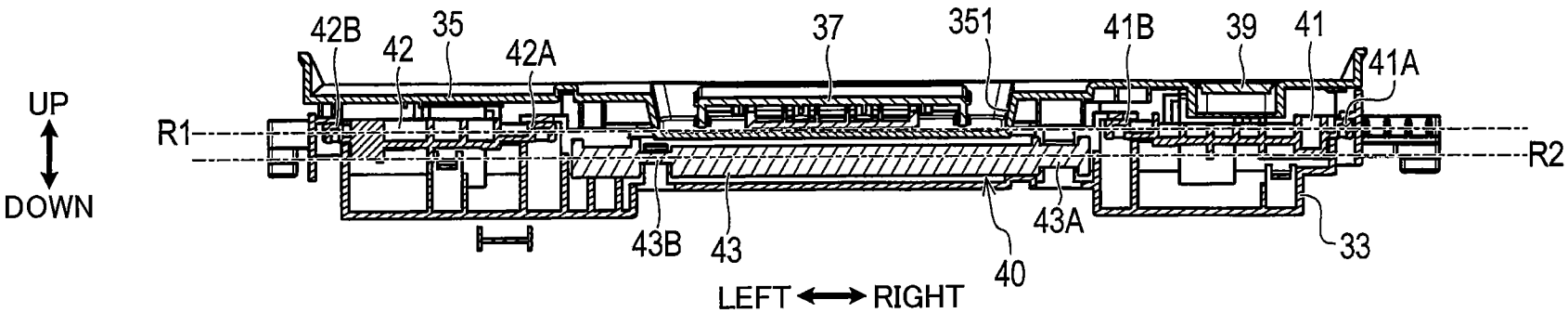
FIG. 9B is a cross-sectional view taken along a line IXB-IXB in FIG. 4A.

As obvious from FIGS. 4A and 4B, the sheet stopper 37 and the accommodating portion 351 are positioned between the first pivot member 41 and the second pivot member 42 when the casing 11 is viewed from the front side. Further, as illustrated in FIG. 9B, the second axis R2 is lower than the first axis R1 in the up-down direction. In the present embodiment, the second axis R2 is positioned immediately below the first axis R1. That is, the first axis R1 and the second axis R2 are aligned with each other when viewed from above. As illustrated in FIG. 10B, the upper surface of the sheet stopper 37 is sloped diagonally downward in a sheet discharging direction (from rear to front in FIG. 10B) in the non-used position of the sheet stopper 37. The up-down direction is an example of a height direction.

As illustrated in FIGS. 10A and 10B, the center shaft 431 and the parallel shaft 432 of the third pivot member 43 is positioned below the accommodating portion 351. The parallel shaft 432 is positioned downstream of the center shaft 431 in the sheet discharging direction on the discharge tray 31. The parallel shaft 432 has an upper surface positioned downward of the upper surface of the center shaft 431. The accommodating portion 351 has a lower surface sloped diagonally downward in the sheet discharging direction (from rear to front in FIG. 10B). The upper surface of the parallel shaft 432 is positioned below the accommodating portion 351, and positioned downward of portions of the third pivot member 43 which is positioned rightward or leftward of the parallel shaft 432.

Advantageous Effects of the Embodiment

According to the multifunction peripheral 1 described above, both the first pivot member 41 including first engaging portion 41C and the second pivot member 42 including the second engaging portion 42C are pivotally movable about the identical pivot axis, that is, the first axis R1. Therefore, the first engaging portion 41C and the second engaging portion 42C is movable by an angle equal to each other so that engagement or disengagement of only one of the first engaging portion 41C and the second engaging portion 42C can be prevented, in comparison with a case where the pivot axis of the first pivot member 41 is different from the pivot axis of the second pivot member 42.

Further, according to the multifunction peripheral 1 described above, the third pivot member 43 is pivotally movable about the second axis R2 that is different from the first axis R1 (i.e., the pivot center of the first pivot member 41 and the second pivot member 42). That is, the first pivot member 41, the second pivot member 42 and the third pivot member 43 are made of shafts different from one another.

Therefore, a space can be provided at a region between the first pivot member 41 and the second pivot member 42, unlike a case in which the first pivot member 41 and the second pivot member 42 are formed of a single shaft. Accordingly, the sheet stopper 37 and the accommodating portion 351 can be provided in the space. This configuration can restrain an increase in dimension of the multifunction peripheral 1 in the up-down direction compared to such a case where: a shaft is provided in the region between the first pivot member 41 and the second pivot member 42; and the sheet stopper 37 and the accommodating portion 351 are provided at a position upward relative to the shaft in order to avoid mechanical interference.

Further, according to the multifunction peripheral 1 described above, lengths of the first pivot member 41, second pivot member 42, and third pivot member 43 in an axial direction (i.e., the left-right direction) can be made small, in comparison with a case where the first pivot member 41 and the second pivot member 42 are made of a single shaft.

Further, the shafts of the first pivot member 41, the second pivot member 42, and the third pivot member 43 are pivotably supported by the bearings 61A and 61B, the bearings 62A and 62B, and the bearings 63A and 63B, respectively. With this configuration, probability of distortion or wrench of the shafts can be lowered in comparison with the case where the first pivot member 41 and the second pivot member 42 are made of a single shaft. Consequently, engagement or disengagement of only one of the first engaging portion 41C and the second engaging portion 42C can be suppressed.

Further, according to the multifunction peripheral 1 described above, the pivotal movement of the first transmission portion 71 causes sliding movement of the first transmission portion 71 relative to the first transmission-receiving portion 72 maintaining contact therebetween, thereby pivotally moving the first transmission-receiving portion 72. Further, the pivotal movement of the second transmission portion 73 causes sliding movement of the second transmission portion 73 relative to the second transmission-receiving portion 74 maintaining contact therebetween, thereby causing the second transmission-receiving portion 74 to be pivotally moved.

Therefore, the contacting portion between the first transmission portion 71 and the first transmission-receiving portion 72, and the contacting portion between the second transmission portion 73 and the second transmission-receiving portion 74 can absorb positional difference between the first axis R1 (the pivot center of the first transmission portion 71 and the second transmission-receiving portion 74) and the second axis R2 (the pivot center of the first transmission-receiving portion 72 and the second transmission portion 73). Hence, the third pivot member 43 and the second pivot member 42 can be smoothly pivotally moved in interlocking relation to pivotally movement of the first pivot member 41.

Further, according to the multifunction peripheral 1 described above, the upper surface of the sheet stopper 37 is inclined diagonally downward from the upstream side toward the downstream side of the sheet discharging direction in the non-used position of the sheet stopper 37. Therefore, the opening 11A above the discharge tray 31 for taking out the sheets can have a space sufficient to take out of the sheets on the discharge tray 31 even though the FB portion 5 is positioned above the main body portion 3. Further, the lower surface of the accommodating portion 351 is inclined diagonally downward in conformance with the shape of the sheet stopper 37. The upper surface of the parallel shaft 432 is positioned below the upper surface of the center shaft 431 in conformance with the inclination of the lower surface. With the above configuration, mechanical interference between the parallel shaft 432 and the accommodating portion 351 does not occur.

Second Embodiment

While the description has been made in detail with reference to the embodiment, it would be apparent that the embodiment described above is merely an example of the disclosure and may be modified in many ways without departing from the scope of the disclosure.

Figure 11:
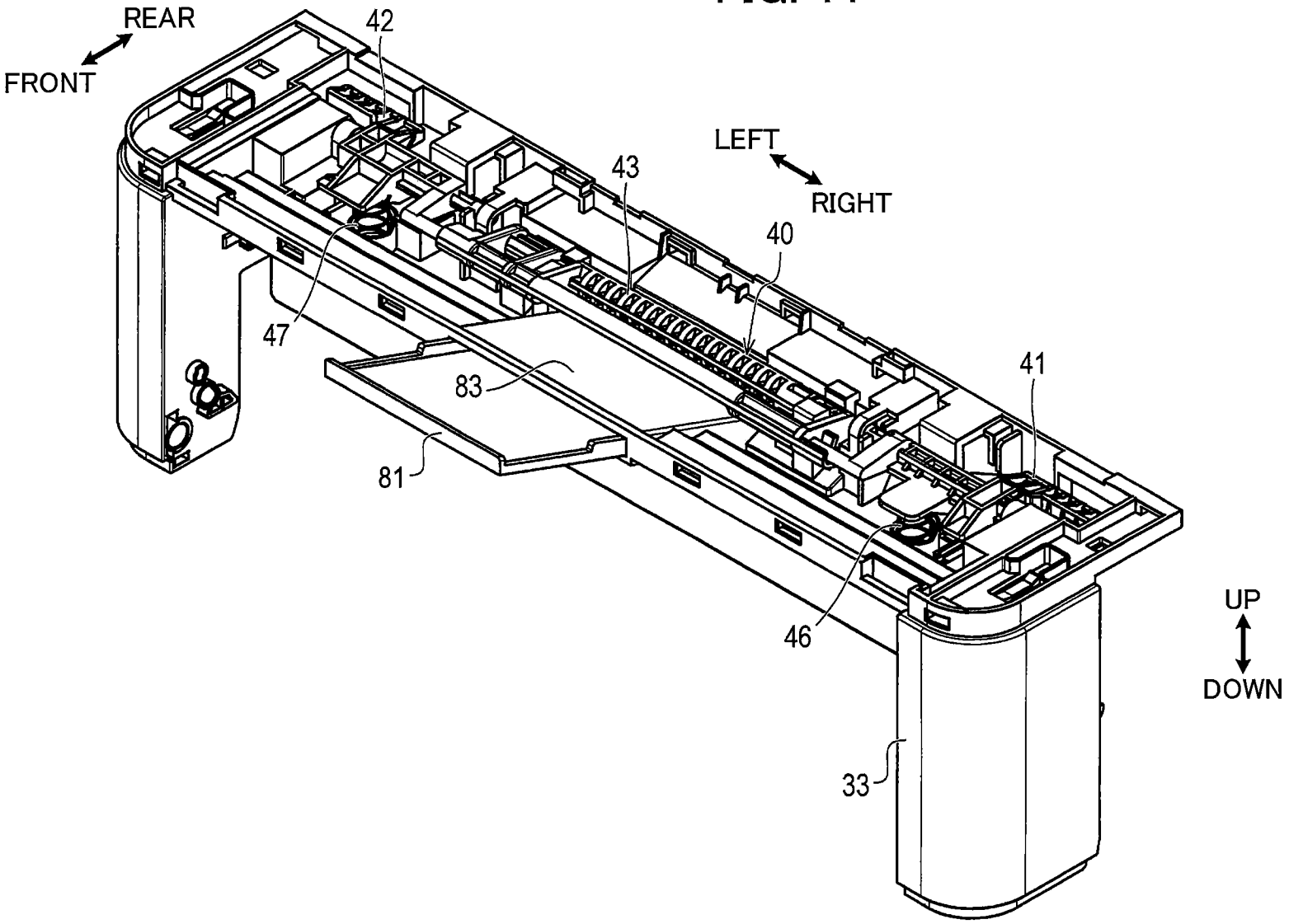
FIG. 11 is a perspective view of a cover unit provided with an extension tray in a multifunction peripheral according to a second embodiment.

A multifunction peripheral according to a second embodiment will be described with reference to FIG. 11 wherein like parts and components are designated by the same reference numerals as those shown in the first embodiment. In the first embodiment, the sheet stopper 37 provided at the cover unit 13 is a folding type stopper. On the other hand, instead of the sheet stopper 37, a pull-out type extension tray 81 is provided at a cover unit 13 in the second embodiment, as illustrated in FIG. 11. An accommodating portion 83 is positioned above the extension tray 81. The extension tray 81 is movable between a used position where the extension tray 81 is ready for use, and a non-used position where the extension tray 81 is not used and accommodated in the accommodating portion 83.

The parallel shaft 432 of the third pivot member 43 is positioned above an upper surface of the accommodating portion 83 so as to avoid mechanical interference between the accommodating portion 83 and the parallel shaft 432. That is, for avoiding mechanical interference between components and the parallel shaft 432, the components such as the extension tray 81 and the accommodating portion 83 may be disposed at a position upward relative to the parallel shaft 432, or downward relative to the parallel shaft 432.

<Modifications>

Further, an operation panel or an NFC device may be desired to be disposed at the front portion of the upper surface of the casing. Even in such cases, by employing the third pivot member 43 described above, the operation panel or the NFC device can be disposed at a portion through which the first axis R1 passes (i.e., at a position between the first pivot member 41 and the second pivot member 42).

Further, in the above-described embodiments, the locking portion 40 is provided at the cover unit 13, while the locked portion 50 is provided at the casing 11. However, a component corresponding to the locking portion 40 may be provided at the casing 11, and a component corresponding to the locked portion 50 may be provided at the cover unit 13. Even with the above configuration, the component corresponding to the locking portion 40 may include members corresponding to the first pivot member 41, the second pivot member 42 and the third pivot member 43, so that a desired component may be positioned at a region between the members corresponding to the first pivot member 41 and the second pivot member 42 to restrain increase in a length in the up-down direction of the multifunction peripheral.

Further, in the above-described embodiments, the first transmission portion 71 and the first transmission-receiving portion 72 are in direct contact with each other, and the second transmission portion 73 and the second transmission-receiving portion 74 are in direct contact with each other.

However, power transmission components such as a gear, a cam, and a link may be interposed between the first pivot member 41 and the third pivot member 43, and between the third pivot member 43 and the second pivot member 42.

Further, in the above-described embodiments, the first transmission portion 71 provided at the first pivot member 41 has the first contact portion 71A, the first transmission receiving portion 72 provided at the third pivot member 43 has the first transmission receiving portion 72A, the second transmission portion 73 provided at the third pivot member 43 has the second transmission portion 73A, and the second transmission receiving portion 74 provided at the second pivot member 42 has the second contact portion 74A. However, the first transmission portion 71 may have a first guide surface, and the first transmission receiving portion 72 may have a first contact portion. Further, the second transmission portion 73 may have a second contact portion, and the second transmission receiving portion 74 may have a second guide surface.

Further, in the above-described embodiments, the first pivot member 41 includes the shafts 41A and 42B, the second pivot member 42 includes the shafts 42A and 42B, and the third pivot member 43 includes the shafts 43A and 43B. Further, the shafts 41A and 41B, the shafts 42A and 42B, and the shafts 43A and 43B are supported by the bearings 61A and 61B, the bearings 62A and 62B, and the bearings 63A and 63B those are provided at the cover body 33, respectively. However, each of the first pivot member 41, the second pivot member 42, and the third pivot member 43 may include bearings, and shafts provided at the cover body 33 may pivotably support bearings. In other words, the first pivot member 41, the second pivot member 42, and the third pivot member 43 may have members having hollow cylindrical shape, and the hollow cylindrical members may be pivotably supported by the shafts provided at the cover body 33.

Incidentally, in order to attain the intended function in the above-described embodiments, the single component may be replaced by a plurality of components, or the plurality of components may be replaced by a single component. Further, a part of the component may be dispensed with. Further, a part of the embodiment may be added to the other embodiment or modifications or may be replaced by a part of the other embodiment or modifications.

What is claimed is:

1. An image forming apparatus comprising:

a casing formed with an opening;

a cover movable between a closed position and an open position, the cover in the closed position closing the opening, the cover in the open position opening the opening; and a locked portion provided at one of the casing and the cover, the locked portion comprising a first engaged portion, and a second engaged portion;

a locking portion provided at a remaining one of the casing and the cover, the locking portion comprising a first pivot member pivotally movable between an engaging position and a release position about a first axis extending in an axial direction, the first pivot member comprising a first shaft, and a first engaging portion configured to be engaged with the first engaged portion, the first engaging portion being engaged with the first engaged portion in the engaging position of the first pivot member, the first engaging portion being disengaged from the first engaged portion in the release position of the first pivot member, a second pivot member spaced apart from the first pivot member in the axial direction and pivotally movable between an engaging position and a release position about the first axis, the second pivot member comprising a second shaft separately formed from the first shaft, and a second engaging portion configured to be engaged with the second engaged portion, the second engaging portion being engaged with the second engaged portion in the engaging position of the second pivot member, the second engaging portion being disengaged from the second engaged portion in the release position of the second pivot member, a third pivot member pivotally movable between a first position and a second position about a second axis extending in the axial direction, the third pivot member being in the first position in a state where the first pivot member and the second pivot member are in the engaging position, the third pivot member being in the second position in a state where the first pivot member and the second pivot member are in the release position, pivotal movement of at least one of the first pivot member, the second pivot member, and the third pivot member causing pivotal movement of remaining of the first pivot member, the second pivot member, and the third pivot member, wherein the third pivot member further comprises a center shaft coaxial with the second axis and disposed below the accommodating portion, the center shaft having an upper surface, and a parallel shaft extending in parallel with the center shaft, the parallel shaft being disposed below the accommodating portion at a position downstream of the center shaft in the sheet discharging direction, the parallel shaft having one end connected to the first transmission-receiving portion and another end connected to the second transmission portion, the parallel shaft having an upper surface positioned lower than the upper surface of the center shaft, wherein, in the non-used position, the sheet stopper has an upper surface inclined diagonally downward from an upstream side toward a downstream side in the sheet discharging direction, and wherein the accommodating portion has a lower surface inclined diagonally downward from the upstream side toward the downstream side in the sheet discharging direction, an urging member urging the first pivot member to be pivotally moved to the engaging position and to urge the second pivot member to be pivotally moved to the engaging position, a first transmission portion provided at the first pivot member, a first transmission-receiving portion provided at the third pivot member, the first transmission portion and the first transmission-receiving portion being in contact with each other at a position away from both the first axis and the second axis, the first transmission portion being slidingly movable relative to the first transmission-receiving portion while maintaining contact with the first transmission-receiving portion to transmit power so as to pivotally move the third pivot member when the first pivot member is pivotally moved, a second transmission portion provided at the third pivot member, and a second transmission-receiving portion provided at the second pivot member the second transmission portion and the second transmission-receiving portion being in contact with each other at a position away from both the first axis and the second axis, the second transmission portion being slidingly movable relative to the second transmission-receiving portion while maintaining contact with the second transmission-receiving portion to transmit power so as to pivotally move the second pivot member when the third pivot member is pivotally moved;

a discharge tray onto which a sheet is configured to be discharged in a sheet discharging direction, the discharge tray being constituted by an upper portion of the casing and having an end portion;

a sheet stopper provided at the end portion of the discharge tray, the sheet stopper being positioned between the first pivot member and the second pivot member in the axial direction, the sheet stopper being movable between a used position at which the sheet stopper is used and a non-used position at which the sheet stopper is not used, the sheet stopper in the used position being configured to prevent a sheet discharged onto the discharge tray from dropping out of the discharge tray; and an accommodating portion provided at the discharge tray and configured to accommodate the sheet stopper in the non-used position, wherein the second axis is lower than the first axis in an up-down direction.

2. The image forming apparatus according to claim 1, wherein one of the first transmission portion and the first transmission-receiving portion has a first guide surface, wherein remaining one of the first transmission portion and the first transmission-receiving portion has a first contact portion movable in sliding contact with the first guide surface, wherein one of the second transmission portion and the second transmission-receiving portion has a second guide surface, and wherein remaining one of the second transmission portion and the second transmission-receiving portion has a second contact portion movable in sliding contact with the second guide surface.

* * * * *